US010286688B2

(12) United States Patent
Mezaki

(10) Patent No.: US 10,286,688 B2
(45) Date of Patent: May 14, 2019

(54) LIQUID DISCHARGE APPARATUS, LIQUID CURING METHOD, AND COMPUTER PROGRAM PRODUCT

(71) Applicant: Daisuke Mezaki, Kanagawa (JP)

(72) Inventor: Daisuke Mezaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/857,529

(22) Filed: Dec. 28, 2017

(65) Prior Publication Data

US 2018/0207956 A1 Jul. 26, 2018

(30) Foreign Application Priority Data

Jan. 25, 2017 (JP) ..... 2017-010938
Dec. 14, 2017 (JP) ..... 2017-239679

(51) Int. Cl.

| | |
|---|---|
| ***B41J 11/00*** | (2006.01) |
| ***B41M 7/00*** | (2006.01) |
| ***B41J 2/145*** | (2006.01) |
| ***B41J 25/308*** | (2006.01) |
| *B41J 2/14* | (2006.01) |

(52) U.S. Cl.

CPC ..... *B41J 11/002* (2013.01); *B41J 2/145* (2013.01); *B41J 25/3082* (2013.01); *B41J 25/3086* (2013.01); *B41M 7/0081* (2013.01); *B41J 2/14016* (2013.01); *B41J 2/14233* (2013.01)

(58) Field of Classification Search

CPC .. B41J 11/002; B41J 25/3082; B41J 25/3086; B41J 2/145; B41J 2/14233; B41J 2/14016; B41M 7/0081

See application file for complete search history.

(56) References Cited

U.S. PATENT DOCUMENTS

2002/0024544 A1 2/2002 Codos
2003/0179270 A1* 9/2003 Yamamoto ..... B41J 2/01 347/102

(Continued)

FOREIGN PATENT DOCUMENTS

JP 2011-230297 11/2011
JP 2012-045877 3/2012

(Continued)

OTHER PUBLICATIONS

European Search Report; Application No. 18151842.4-1019; dated Jun. 7, 2018.

*Primary Examiner* — Yaovi M Ameh
(74) *Attorney, Agent, or Firm* — Duft & Bornsen, PC

(57) ABSTRACT

A liquid discharge apparatus includes a liquid discharge head to discharge liquid to a medium to form liquid surface on the medium, an irradiator to radiate active energy rays onto the liquid surface, a carriage mounting the liquid discharge head and the irradiator, a scanner to scan the carriage in a main scanning direction, a height adjuster to adjust an irradiation distance between the irradiator and the liquid surface by relatively moving the carriage and the medium, a conveyor to move the medium and the carriage relatively in a sub-scanning direction perpendicular to the main scanning direction, and control circuitry to control the irradiator to irradiate the liquid surface with the active energy rays while scanning the carriage in the main scanning direction.

9 Claims, 14 Drawing Sheets

(56) References Cited

U.S. PATENT DOCUMENTS

| | | | | |
|---|---|---|---|---|
| 2008/0182030 | A1* | 7/2008 | Oyanagi | B41J 11/002 427/511 |
| 2010/0165021 | A1* | 7/2010 | Mitsuzawa | B41J 11/002 347/9 |
| 2016/0152043 | A1 | 6/2016 | Mezaki | |
| 2017/0080720 | A1 | 3/2017 | Mezaki | |

FOREIGN PATENT DOCUMENTS

| | | | |
|---|---|---|---|
| JP | 2012-106473 | | 6/2012 |
| JP | 2015-063057 | | 4/2015 |
| JP | 2015-168067 | | 9/2015 |
| JP | 2015-186918 | | 10/2015 |
| WO | WO2011/099559 | A1 | 8/2011 |

* cited by examiner

LIQUID DISCHARGE APPARATUS, LIQUID CURING METHOD, AND COMPUTER PROGRAM PRODUCT

CROSS-REFERENCE TO RELATED APPLICATIONS

This patent application is based on and claims priority pursuant to 35 U.S.C. § 119(a) to Japanese Patent Application No. 2017-010938, filed on Jan. 25, 2017 in the Japan Patent Office and Japanese Patent Application No. 2017-239679, filed on Dec. 14, 2017 in the Japan Patent Office, the entire disclosures of which are hereby incorporated by reference herein.

BACKGROUND

Technical Field

Aspects of the present disclosure relate to a liquid discharge apparatus, a liquid curing method, and a computer program product.

Related Art

Conventionally, a technique for forming an image by using an active energy rays-curable liquid such as a UV-(ultraviolet-) curable ink or the like is known. In such a technique, UV-curable ink is discharged onto a medium and irradiated and cured with UV light to form an image.

In such a technique, it is also possible to change the texture of the image formed on the medium by changing timing of curing of the UV-curable ink. For example, a method of immediately curing a UV-curable ink discharged onto a medium can form an image with a matte feel since the discharged UV-curable ink is cured before becoming smooth. Further, a method of curing the UV-curable ink after a certain period of time can form glossy images since the discharged UV-curable ink is cured only after UV-curable ink has become smooth.

In terms of productivity, the method of curing the UV-curable ink after a certain period of time is generally performed by discharging the UV-curable ink over multiple scans and collectively curing the UV-curable ink instead of curing the UV-curable ink every time the UV-curable ink is discharged in a single scan.

Therefore, an image formed on the medium by discharging the UV-curable ink for a plurality of scans that is larger than the irradiation width of UV light requires multiple UV irradiations because a single UV irradiation cannot cure the entire liquid surface 102.

However, when UV irradiation process is performed multiple times, a cured (hardened) portion cured by the UV irradiation process and an uncured (unhardened) portion not irradiated and not cured by the UV irradiation process are created on the liquid surface 102 for each time UV irradiation is performed. As a result, wrinkles are created at a boundary between the cured portion and the uncured portion because curing shrinkage of the UV-curable ink occurs in the cured portion. Thus, the quality of the image deteriorates.

SUMMARY

In an aspect of this disclosure, a novel liquid discharge apparatus includes a liquid discharge head to discharge liquid to a medium to form liquid surface on the medium, an irradiator to irradiate the liquid surface with active energy rays, a carriage mounting the liquid discharge head and the irradiator, a scanner to scan the carriage in a main scanning direction, a height adjuster to adjust an irradiation distance between the irradiator and the liquid surface by relatively moving the carriage and the medium, a conveyor to move the medium and the carriage relatively in a sub-scanning direction perpendicular to the main scanning direction, and control circuitry to irradiate the liquid surface with the active energy rays by the irradiator while scanning the carriage in the main scanning direction. The height adjuster adjusts the irradiation distance at a first distance in response to a maximum width of the liquid surface in the sub-scanning direction being a first width and adjusts the irradiation distance at a second distance larger than the first distance in response to the maximum width of the liquid surface in the sub-scanning direction being a second width larger than the first width. The control circuitry controls the irradiator to irradiate the liquid surface with the active energy rays while maintaining the irradiation distance at the first distance or the second distance determined by the maximum width by the height adjuster.

In another aspect of this disclosure, a novel liquid curing method includes discharging liquid to a medium to form liquid surface on the medium, irradiating the liquid surface with active energy rays using an irradiator, adjusting an irradiation distance between the irradiator and the liquid surface by relatively moving the irradiator with the medium, scanning the irradiator in a main scanning direction, moving the medium and the irradiator relatively in a sub-scanning direction perpendicular to the main scanning direction, and controlling irradiation of the liquid surface with the active energy rays while scanning the irradiator in the main scanning direction. The adjusting adjusts the irradiation distance at a first distance in response to a maximum width of the liquid surface in the sub-scanning direction being a first width and adjusts the irradiation distance at a second distance larger than the first distance in response to the maximum width of the liquid surface in the sub-scanning direction being a second width larger than the first width, and the controlling irradiates the liquid surface with the active energy rays while maintaining the irradiation distance at the first distance or the second distance determined by the maximum width.

In still another aspect of this disclosure, a novel computer program product includes a non-transitory computer-readable medium containing an information processing program, the program causing a computer in a device to perform discharging liquid to a medium to form liquid surface on the medium with a liquid discharge head, irradiating the liquid surface with active energy rays using an irradiator, adjusting an irradiation distance between the irradiator and the liquid surface by relatively moving the irradiator with the medium, scanning the irradiator in a main scanning direction, moving the medium and the irradiator relatively in a sub-scanning direction perpendicular to the main scanning direction, and controlling irradiation of the liquid surface with the active energy rays while scanning the irradiator in the main scanning direction. The adjusting adjusts the irradiation distance at a first distance in response to a maximum width of the liquid surface in the sub-scanning direction being a first width and adjusts the irradiation distance at a second distance larger than the first distance in response to the maximum width of the liquid surface in the sub-scanning direction being a second width larger than the first width, and the controlling irradiates the liquid surface with the active energy rays while maintaining the irradiation distance at the first distance or the second distance determined by the maximum width.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
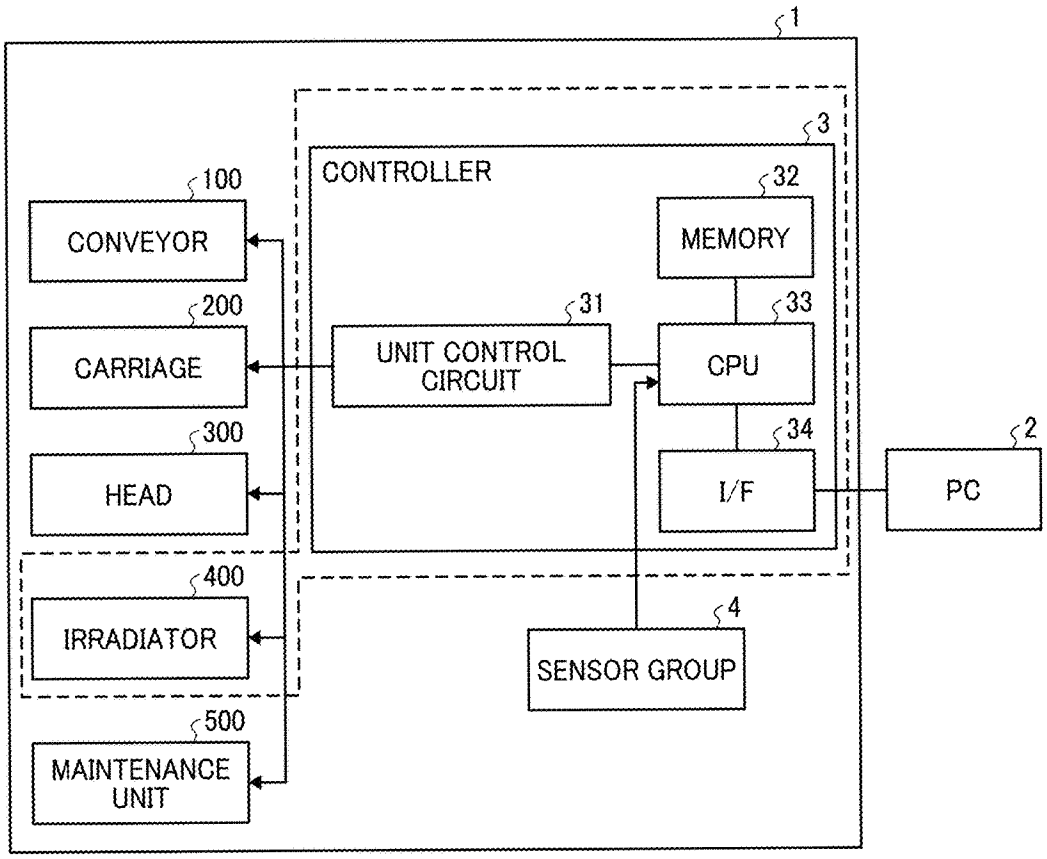
FIG. 1 is a block diagram of an example of a hardware structure of a liquid discharge apparatus according to the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of the present disclosure are described with reference to the attached drawings.

A liquid discharge apparatus according to an embodiment of the present disclosure is described with reference to the accompanying drawings.

The liquid discharge apparatus includes a liquid discharge head that discharges liquid from nozzles, a carriage to mount the liquid discharge head to move horizontally and vertically, and a maintenance unit to maintain the liquid discharge head. Hereinafter, a liquid discharge apparatus, a method for curing liquid, and a computer program product according to an embodiments of the present disclosure will be described referring to accompanying drawings. In following description, an inkjet apparatus using a UV (ultraviolet) curable ink will be described as an example of a liquid discharge apparatus. However, note that the liquid discharge apparatus according to the present embodiment is not limited to an inkjet apparatus of UV (ultraviolet) curable ink.

Figure 2:
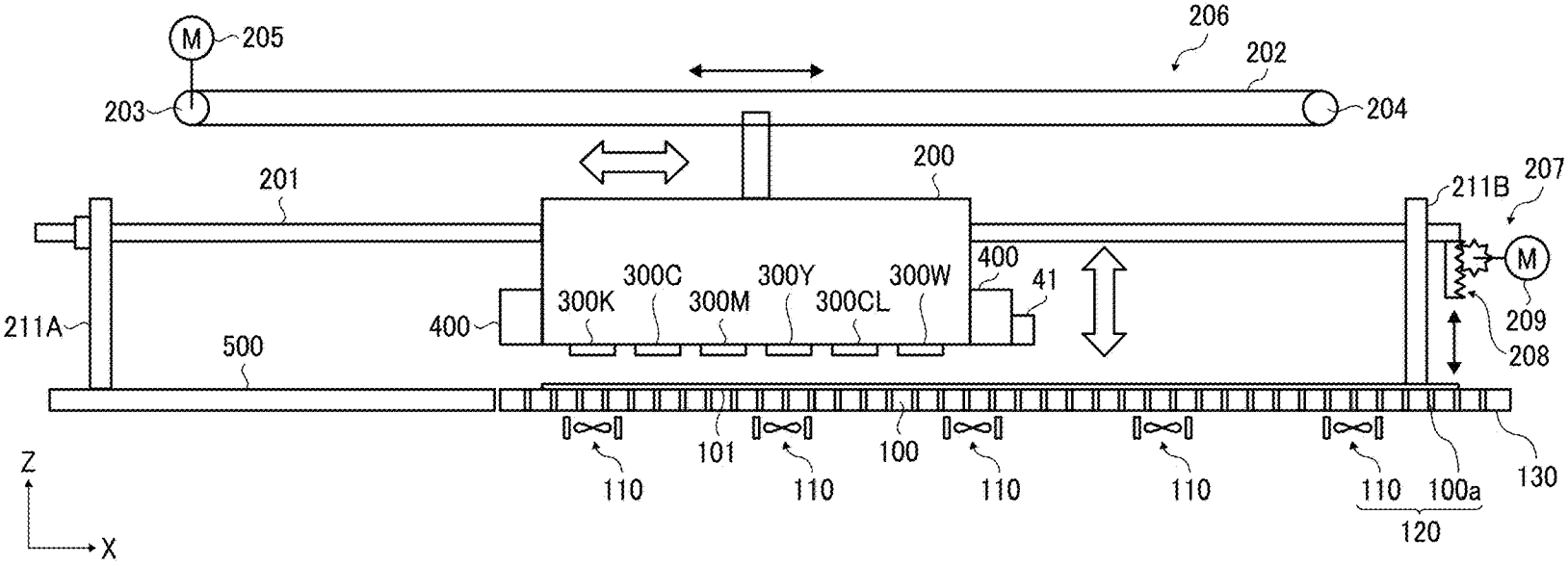
FIG. 2 is a schematic front view of the liquid discharge apparatus according to the present disclosure.
Figure 3:
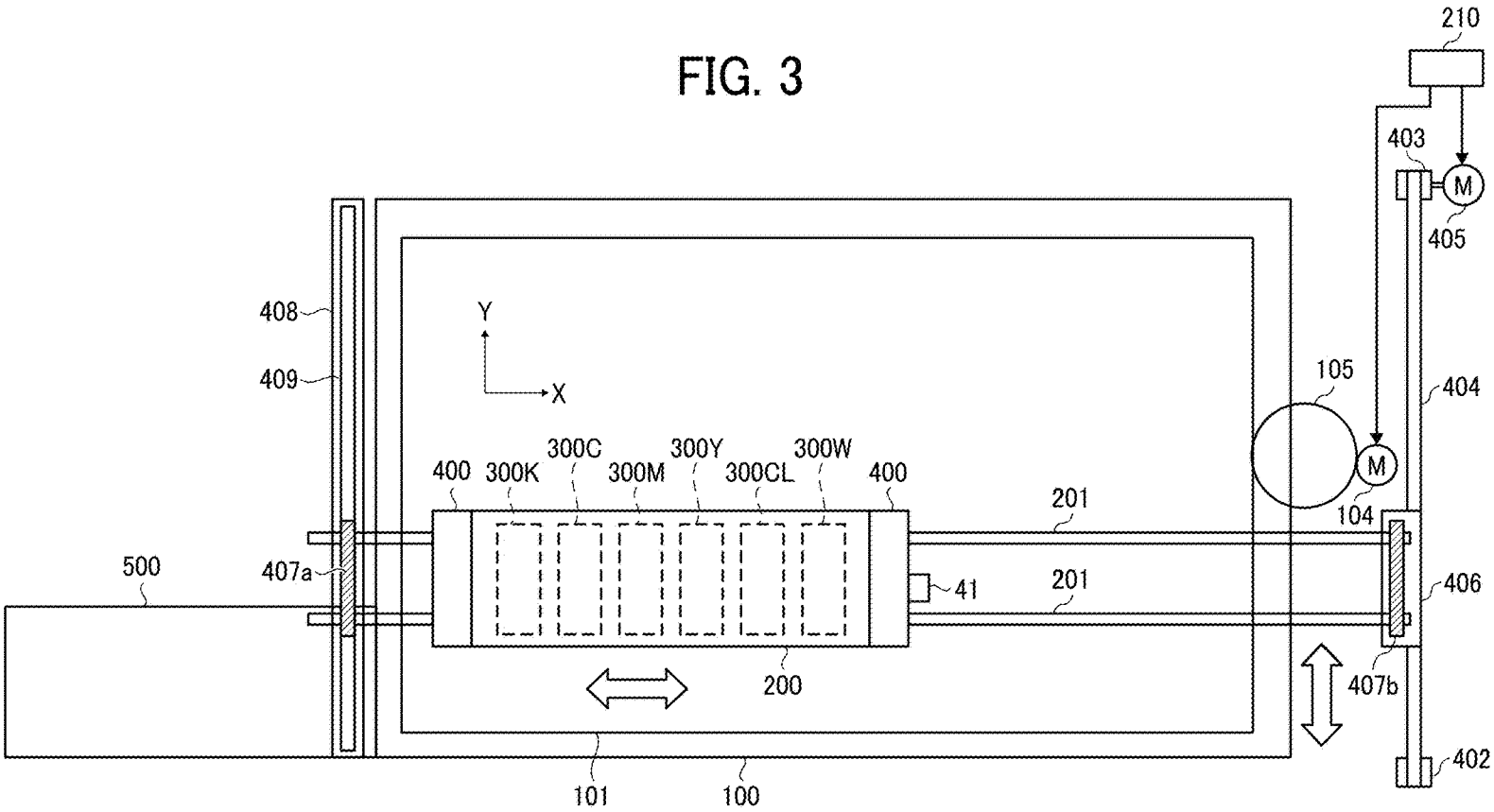
FIG. 3 is a schematic plan view of the liquid discharge apparatus according to the present disclosure.

FIG. 1 is a block diagram of a hardware configuration of a liquid discharge apparatus 1 according to the present disclosure. FIG. 2 is a schematic front view of the liquid discharge apparatus 1 of the present embodiment. FIG. 3 is a top view of the liquid discharge apparatus 1 of the present embodiment.

As illustrated in FIG. 1, the liquid discharge apparatus 1 according to the present embodiment includes controller (control circuitry) 3, a sensor group 4, a conveyor 100, a carriage 200, liquid discharge heads 300, an irradiator 400, and a maintenance unit 500. The liquid discharge heads 300 are an example of a liquid discharge device. Hereinafter, the "liquid discharge head" is simply referred to as "head".

Further, the controller 3 includes unit control circuitry 31, a memory 32, a CPU (Central Processing Unit) 33, and an I/F (Interface) 34. As illustrated by a broken line in FIG. 1, a curing device may be an apparatus including at least the controller 3 and the irradiator 400.

The I/F 34 is an interface for connecting the liquid discharge apparatus 1 to an external PC (Personal Computer) 2. A form of connection between the liquid discharge apparatus 1 and the PC 2 may be any type. For example, the liquid discharge apparatus 1 and the PC 2 may be connected via a network or directly connected by a communication cable.

Examples of the sensor group 4 include various sensors provided in the liquid discharge apparatus 1 such as the height sensor 41 illustrated in FIGS. 2 and 3.

The CPU 33 uses the memory 32 as a work area to control the operation of each unit of the liquid discharge apparatus 1 via the unit control circuitry 31. Specifically, the CPU 33 controls the operation of each unit based on print data received from the PC 2 and the data detected by the sensor group 4. The CPU 33 forms an image on a substrate 101. The "image" formed on a substrate 101 is also referred to as a "liquid surface 102". The substrate 101 is an example of a medium onto which the liquid is discharged. Thus, the "substrate" is also referred to as a "medium".

Note that a printer driver is installed in the PC 2. The printer driver generates print data from image data. The print data is transmitted to the liquid discharge apparatus 1. The print data includes command data and pixel data. The command data is used for operating the conveyor 100 of the liquid discharge apparatus 1, for example. The pixel data relates to the image (liquid surface 102) formed on the substrate 101. The pixel data is composed of 2-bit data for each pixel and is represented by four gradations.

The conveyor 100 includes a stage 130 and a suction mechanism 120. The suction mechanism 120 includes fans 110 and suction holes 100*a* formed in the stage 130. The suction mechanism 120 drives the fans 110 to vacuum the substrate 101 to the stage 130 through the suction holes 100*a*. The substrate 101 is thus temporary fixed to the stage 130 of the conveyor 100 by the suction mechanism 120.

The suction mechanism 120 may also attract the substrate 101 to the stage 130 with electrostatic force. The stage 130 is controlled to move in a Y-axis direction (sub-scanning direction) based on a drive signal from the CPU 33 (unit control circuitry 31). As illustrated in FIG. 3, the conveyor 100 includes a conveyance controller 210, a roller 105, and a motor 104. The conveyance controller 210 drives the motor 104 to rotate the roller 105 to move the substrate 101 in the sub-scanning direction (Y-axis direction).

The conveyor 100 may move the carriage 200 in the sub-scanning direction (Y-axis direction) instead of moving the substrate 101. That is, the conveyor 100 relatively moves the substrate 101 and the carriage 200 in the sub-scanning direction (Y-axis direction).

For example, as illustrated in right side in FIG. 3, the conveyor 100 includes a side plate 407*b* that supports two guides 201 that guide the carriage 200 in the main scanning direction (X-axis direction), a base 406 to support the side plate 407*b*, a belt 404 that is fixed to the base 406 and wound around a drive pulley 403 and a driven pulley 402, a motor 405 that drives and rotates the drive pulley 403, and a conveyance controller 210.

Similarly, as illustrated in left side in FIG. 3, the conveyor 100 includes a side plate 407*a* that supports two guides 201 that guide the carriage 200 in the main scanning direction (X-axis direction), a base 408 to slidably support the side plate 407*a*, a groove 409 formed on the base 408 to guide the side plate 407*a* to move in the sub-scanning direction (Y-axis direction).

The conveyance controller 210 of the conveyor 100 drives the motor 405 to rotate the drive pulley 403 to move the belt 404 in the sub-scanning direction (Y-axis direction). The carriage 200 moves in the Y-axis direction (sub-scanning direction) by moving the base 406 and the side plate 407*b* in the Y-axis direction (sub-scanning direction) with movement of the belt 404.

The side plate 407*a* moves in the sub-scanning direction along the groove 409 of the base 408 as the base 406 moves in the sub-scanning direction. The heads 300 includes heads 300K, 300C, 300M, 300Y, 300CL, and 300W that respectively discharges UV-curable inks of the colors black (K), cyan (C), magenta (M), yellow (Y), clear (CL), and white (W).

The UV-curable ink is an example of a liquid curable by active energy rays. The heads 300K, 300C, 300M, 300Y, 300CL, and 300W are provided on the lower surface of the carriage 200. Each heads 300K, 300C, 300M, 300Y, 300CL, and 300W has a piezoelectric element, a liquid chamber, and a nozzle. The CPU 33 (unit control circuitry 31) applies drive signals to the piezoelectric elements to cause the piezoelectric elements to deform toward the nozzle so that the liquid in the liquid chamber is discharged from the nozzle. Thus, the UV-curable ink is discharged onto the substrate 101. Thus, the liquid surface 102 is formed on the substrate 101.

As UV-curable ink suitable for the present embodiment, ink containing a methacrylate monomer may be listed as an example. Although the methacrylate monomer has an advantage of comparatively weak skin sensibility, the methacrylate monomer has a characteristic that degree of cure shrinkage of the methacrylate monomer is larger than the cure shrinkage of ordinary inks.

The irradiator 400 is provided on a side surface of the carriage 200 in the X-axis direction. The irradiator 400 irradiates UV light (an example of active energy rays) to the liquid surface 102 based on a driving signal from the CPU 33 (unit control circuitry 31). The irradiator 400 is mainly constituted by a UV irradiation lamp that irradiates UV light.

The CPU 33 (unit control circuitry 31) controls the carriage 200 to move in a Z-axis direction (height direction) and a main scanning direction (X-axis direction) by drive signals generated by the CPU 33. Thus, the carriage 200 scans and moves in the main scanning direction (X-axis direction) along the guide 201. The scanner 206 includes a driving pulley 203, a driven pulley 204, a driving belt 202, and a motor 205. The carriage 200 is fixed to the driving belt 202 wound around the driving pulley 203 and the driven pulley 204. By driving the driving belt 202 with the motor 205, the carriage 200 moves to the right and left in the main scanning direction (X-axis direction).

The guide 201 is supported by the side plate 211A and the 211B of the apparatus body. The height adjuster 207 has a motor 209 and a slider 208. The height adjuster 207 drives the motor 209 to vertically move the slider 208 to move the guide 201 vertically. As the guide 201 moves vertically, the carriage 200 moves vertically, and thus the height of the carriage 200 with respect to the substrate 101 can be adjusted.

Next, image formation using the liquid discharge apparatus 1 is described.

First, the conveyor 100 moves the substrate 101 to an initial position in the Y-axis direction (sub-scanning direction) based on the drive signal transmitted from the CPU 33 (unit control circuitry 31) to form the image (liquid surface 102) on the substrate 101.

Next, the height adjuster 207 adjusts a height of the carriage 200 by moving the carriage 200 in the Z-axis direction (height direction) based on the drive signal transmitted from the CPU 33 (unit control circuitry 31).

The height adjuster 207 moves the carriage to a height suitable for discharging UV-curable ink by the heads 300. For example, the height at which the gap between the heads 300 and the substrate 101 is 1 mm. The height of the heads 300 is detected by the height sensor 41 so that the height of the heads 300 is controlled by the CPU 33.

The carriage 200 reciprocally moves in the X-axis direction (main scanning direction) based on the driving signal transmitted from the CPU 33 (unit control circuitry 31). The heads 300 discharges UV-curable ink based on the drive signal transmitted from the CPU 33 (unit control circuitry 31) during reciprocal movement of the carriage 200. Thus, an image (liquid surface 102) is formed on the substrate 101 for one scan.

The conveyor 100 moves the substrate 101 in the Y-axis direction (sub-scanning direction) for one scan based on the drive signal from the CPU 33 (unit control circuitry 31) after the image (liquid surface 102) is formed on the substrate 101 for one scan.

The operation of forming an image (liquid surface 102) for one scan and the operation of moving the substrate 101 and carriage 200 relatively in the Y-axis direction (sub-scanning direction) for one scan are alternatively performed until the formation of the image (liquid surface 102) is completed.

The liquid discharge apparatus 1 waits for a certain period of time (also referred to as "leveling time") during which the liquid surface 102 of the UV-curable ink is leveled (smoothed) after the formation of the image (liquid surface 102) on the substrate 101 is completed. Then, the irradiator 400 irradiates UV light to the liquid surface 102.

The irradiator 400 irradiates the liquid surface 102 with UV light to during scanning the carriage 200 in the main scanning direction (X-axis direction) after moving the carriage 200 at the height suitable for discharging the UV-curable ink by the heads 300.

Figure 4:
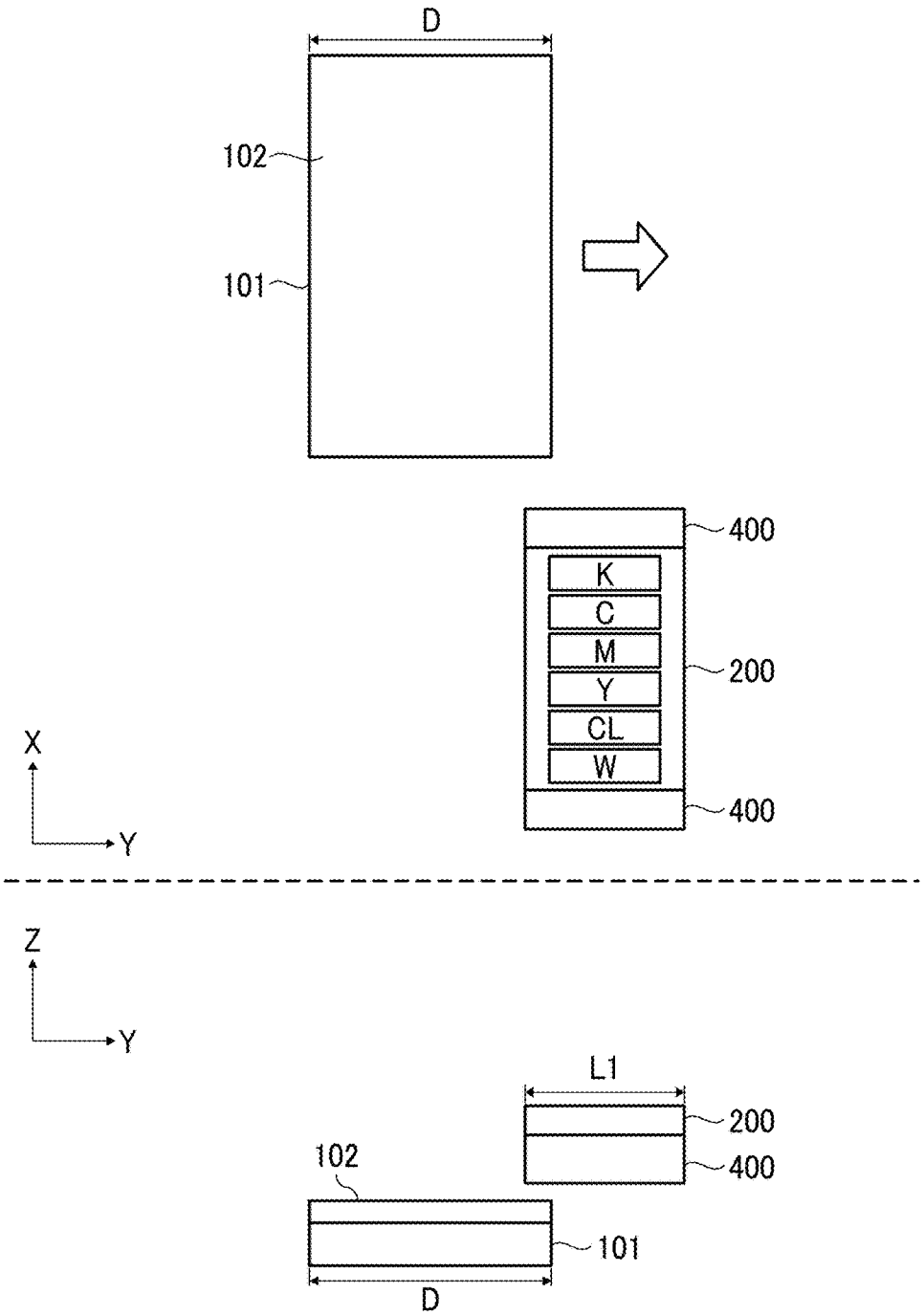
FIG. 4 is a schematic plan view and cross-sectional view of the liquid discharge apparatus illustrating an example of an irradiation operation in the present disclosure.

As illustrated in FIG. 4, a width D of the liquid surface (image) 102 formed on the substrate 101 is larger than an irradiation width L1 of the UV light irradiated from the irradiator 400 in the sub-scanning direction (Y-axis direction) (D>L1). At this time, the carriage 200 is at the height as described above, for example, the height at which the irradiation distance (gap) h between the heads 300 and the liquid surface 102 is 1 mm. The irradiation distance h is a height (distance) from the liquid surface 102 (irradiation surface) to the irradiator 400.

Figure 5:
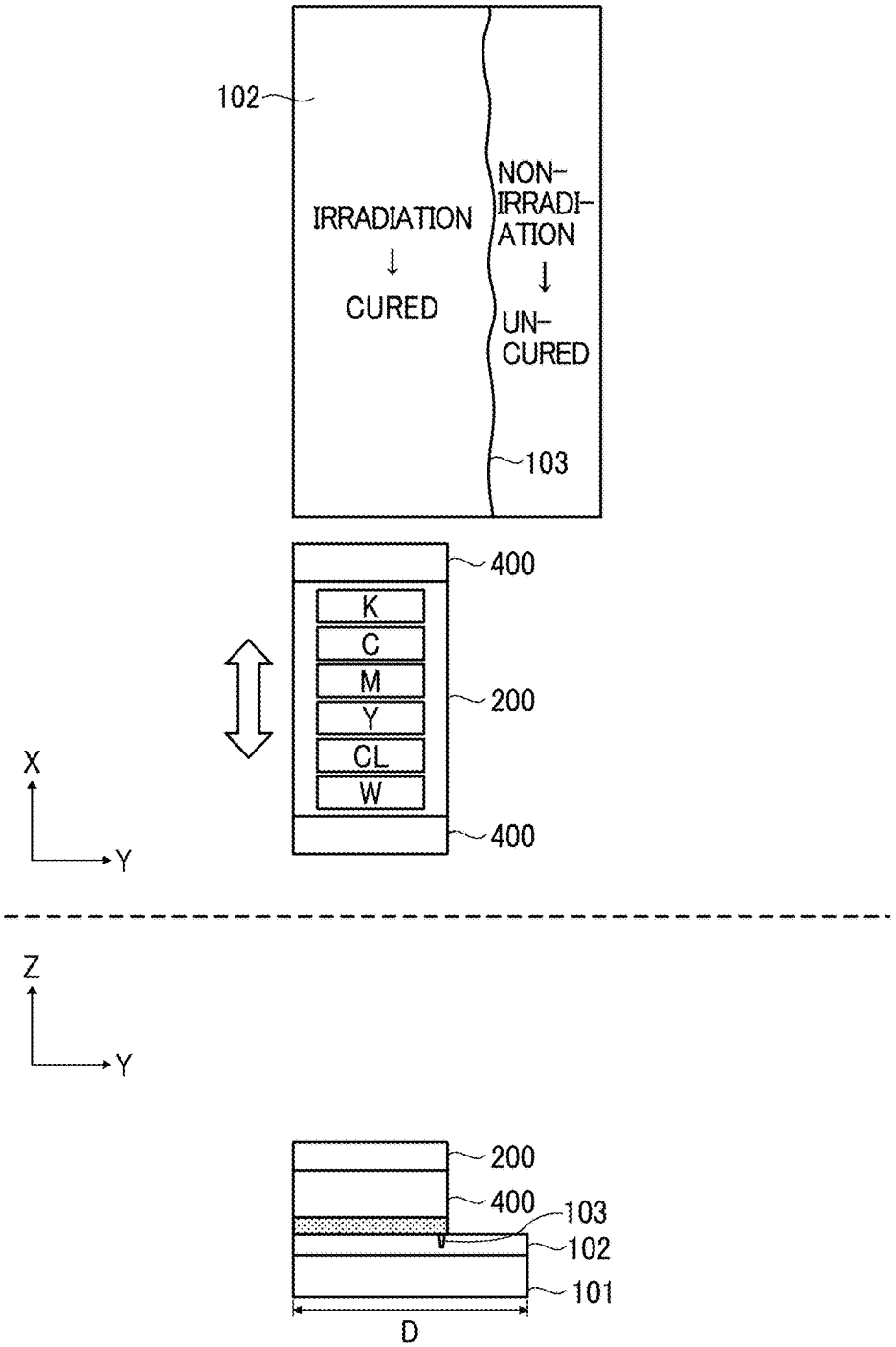
FIG. 5 is a schematic plan view and cross-sectional view of the liquid discharge apparatus illustrating an example of a conventional irradiation operation.

Thus, it is necessary to irradiate the liquid surface 102 multiple times with the UV light to irradiate all the liquid surface 102 when the irradiator 400 irradiates the liquid surface 102 from the above described height of 1 mm. In other words, the carriage 200 has to move reciprocally in the main scanning direction (X-axis direction) every time the relative positions of the irradiator 400 and the substrate 101 in the sub-scanning direction are changed by relatively moving the carriage 200 and the substrate 101 in the sub-scanning direction (Y-axis direction). However, as illustrated in FIG. 5, a cured portion (hardened portion) cured by UV irradiation with the UV light and an uncured portion (unhardened portion) that is not irradiated with the UV light and not cured by UV irradiation are created on the liquid surface 102 every time the UV irradiation process is performed. As a result, curing shrinkage of the UV-curable ink occurs in the cured portion, and curing shrinkage of the UV-curable ink does not occur in the uncured portion. Thus, wrinkles 103 are formed at a boundary between the cured portion and the uncured portion, forming a coating film with poor appearance. Thus, the quality of the liquid surface (image) 102 deteriorates.

Note that the coating film may be obtained by curing the UV-curable ink of colors (K, C, M, Y, and W) or UV-curable ink (UV) itself. In addition, the coating film may be obtained by curing clear (CL) UV-curable ink applied on top of curable ink of colors (K, C, M, Y, and W).

In order to avoid such a problem, in the present embodiment, a height of the irradiator 400 for performing an irradiation of the UV light is adjusted.

Figure 6:
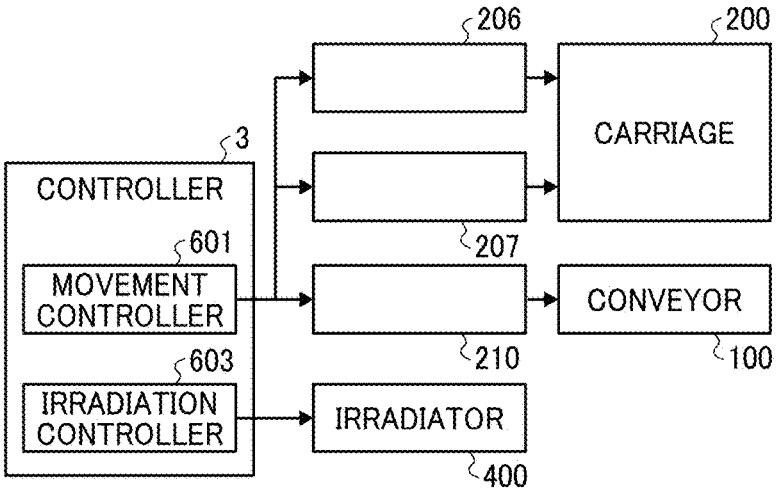
FIG. 6 is a block diagram of a functional configuration of the liquid discharge apparatus (controller) according to the present disclosure.

FIG. 6 is a block diagram of a functional configuration of the liquid discharge apparatus 1 (controller 3) according to the present disclosure.

As illustrated in FIG. 6, the controller 3 of the liquid discharge apparatus 1 includes a movement controller 601 and an irradiation controller 603. The movement controller 601 controls the scanner 206, the height adjuster 207, and the conveyance controller 210. The irradiation controller 603 controls the UV irradiation process of the irradiator 400.

The movement controller 601 moves the irradiator 400 (carriage 200) to a height at which the irradiation distance h between the irradiator 400 and the liquid surface 102 on the substrate 101 is equal to or larger than a distance according the width D of the liquid surface 102.

Then, the movement controller 601 moves the irradiator 400 (carriage 200) in the main scanning direction (X-axis direction) perpendicular to a direction of the width D of the liquid surface 102. The direction of the width D is along the sub-scanning direction (Y-axis direction).

The movement controller 601 controls the scanner 206 to move the carriage 200 in the main scanning direction (X-axis direction) and controls the height adjuster 207 to adjust the position in a height direction (Z-axis direction) of the carriage 200 and controls the conveyance controller 210 to convey the substrate 101 of the conveyor 100 in the sub-scanning direction (Y-axis direction).

The distance according to the width D of the liquid surface 102 is a distance at which the irradiator 400 is capable of irradiating the liquid surface 102 at once by the UV light (active energy rays) in the sub-scanning direction (Y-axis direction).

In other words, the irradiation distance is a distance in which the active energy rays (UV light) irradiated from the irradiator 400 covers a maximum width Dmax of the liquid surface 102 in the sub-scanning direction (Y-axis direction).

While the irradiator 400 (carriage 200) moves and scans in the main scanning direction (X-axis direction) perpendicular to the direction of the width D (sub-scanning direction, Y-axis direction) of the liquid surface 102, the irradiation controller 603 controls the irradiator 400 to irradiate and cure the liquid surface 102 with the UV light (active energy rays).

Figure 7:
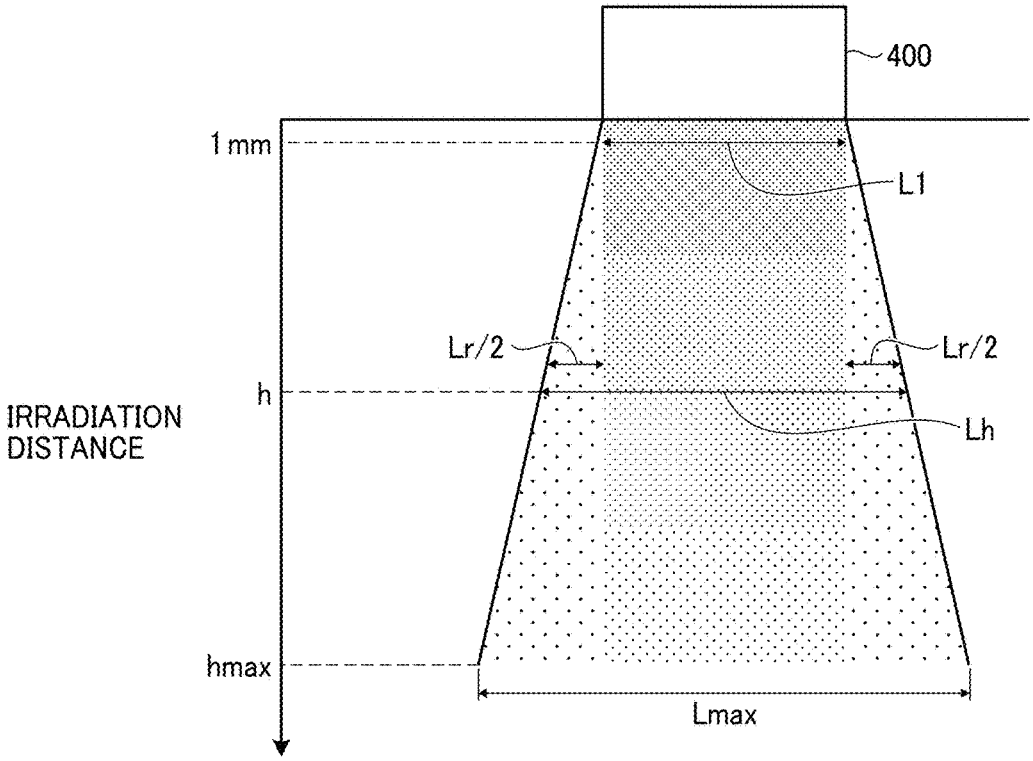
FIG. 7 is an explanatory cross-sectional view of an example of the relation between an irradiation distance of UV light of an irradiator and the irradiation width of the irradiator according to the present embodiment.

FIG. 7 is a cross-sectional view of the irradiator 400 and the liquid surface 102 that explains an example of a relation between the irradiation distance of the UV light of the irradiator 400 and an irradiation width L of the present disclosure. The irradiation distance h is the gap (distance) between the irradiator 400 and the liquid surface 102.

As illustrated in FIG. 7, when the irradiation distance h of the UV light is 1 mm, the irradiation width L of the UV light in the sub-scanning direction is L1. As described above, the irradiation distance h=1 mm of the UV light is used when the irradiator 400 irradiates the UV light from the height suitable for discharging the UV-curable ink by the heads 300. As the irradiation distance h of UV light increases, the irradiation width (irradiation range) L of the UV light in the sub-scanning direction (Y-axis direction) also increases.

Figure 8:
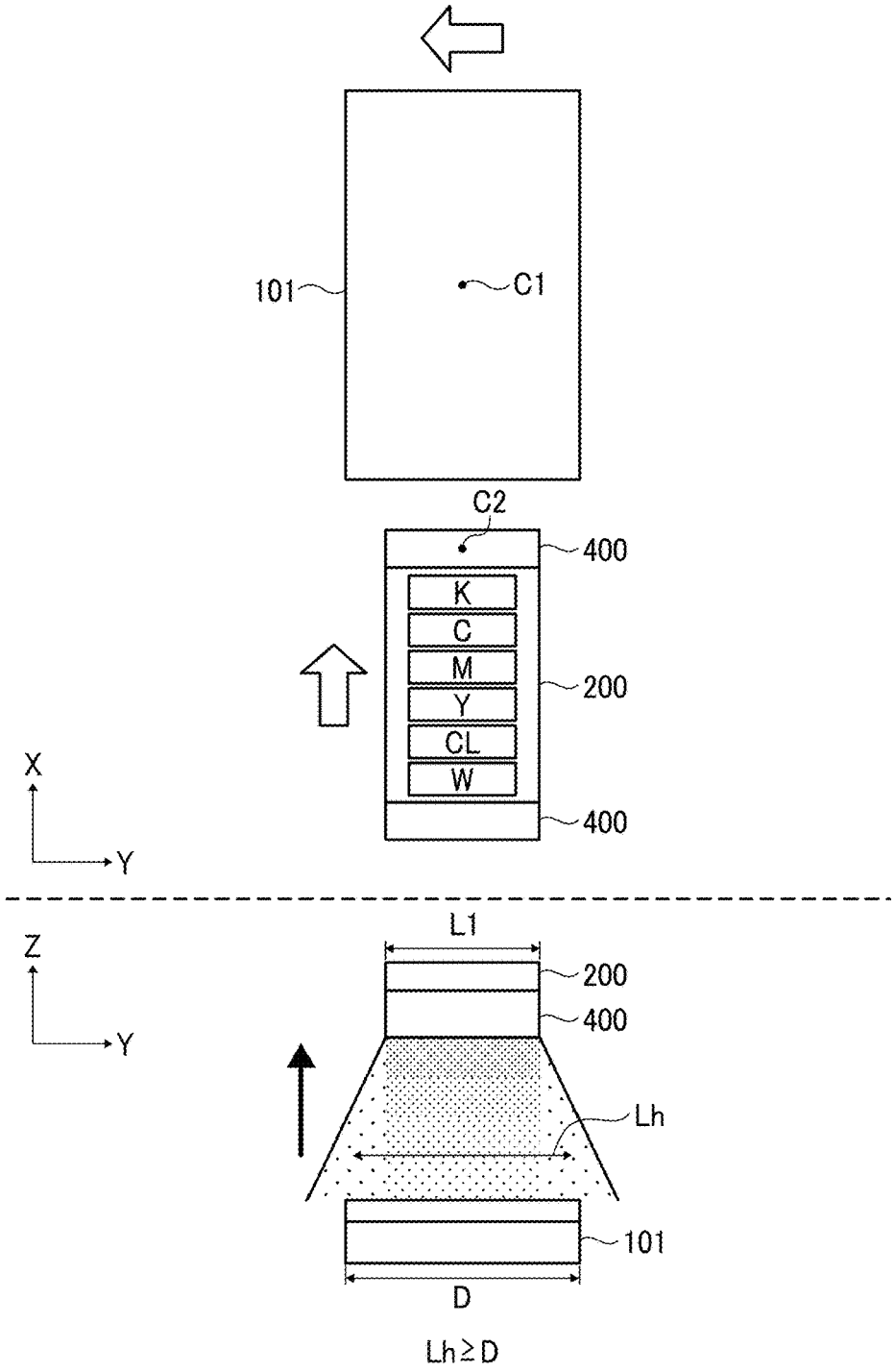
FIG. 8 is a schematic plan view and cross-sectional view of the liquid discharge apparatus illustrating an example of an irradiation operation in the present disclosure.

Therefore, as illustrated in FIG. 8, the movement controller 601 controls the height adjuster 207 to move the irradiator 400 (carriage 200) to the irradiation distance h at which the irradiation width Lh of the UV light becomes equal to or larger than the width D (Lh≥D) of the liquid surface 102 in the sub-scanning direction (Y-axis direction).

Here, the irradiation distance h is a distance from the irradiator 400 to the liquid surface 102 formed on the substrate 101. Then, the movement controller 601 controls the scanner 206 to reciprocally scans the irradiator 400 (carriage 200) in the main scanning direction (X-axis direction) of the liquid surface 102.

In the present embodiment, the memory 32 previously stores information indicating the relation between the irradiation distance h of the UV light and the irradiation width L in the sub-scanning direction (Y-axis direction) of the UV light. The width D in the sub-scanning direction of the liquid surface 102 can be specified from the recording data received from the PC 2.

Thus, the movement controller 601 can specify the irradiation distance h of the UV light at which the irradiation width Lh of the UV light is equal to or larger than the width D of the liquid surface 102 in the sub-scanning direction (Y-axis direction). Further, the movement controller 601 can specify a height of the irradiator 400 (carriage 200) corresponding to the specified irradiation distance h.

The irradiation controller 603 controls the irradiator 400 to irradiate and cure all the liquid surface 102 at once with the UV light while the irradiator 400 (carriage 200) reciprocally moves in the main scanning direction (X-axis direction) of the liquid surface 102.

Thus, the uncured portion is not formed on the liquid surface 102, and formation of the coating film having poor appearance can be prevented. Thus, deterioration of the quality of the image (liquid surface 102) can be prevented.

The height adjuster 207 adjusts the irradiation distance h at a first distance (1 mm) in response to a maximum width Dmax of the liquid surface 102 in the sub-scanning direction (Y-axis direction) being a first width and adjusts the irradiation distance h at a second distance (hmax) larger than the first distance (1 mm) in response to the maximum width Dmax of the liquid surface 102 in the sub-scanning direction (Y-axis direction) being a second width larger than the first width.

In a state where the irradiation distance h is maintained at the first distance or the second distance, the controller 3 irradiates the UV light (active energy rays) from the irradiator 400 to the liquid surface 102.

As illustrated in FIG. 8, the movement controller 601 previously relatively moves the substrate 101 and the irradiator 400 in the sub-scanning direction (Y-axis direction) so that a center C1 of the liquid surface 102 and a center C2 of the irradiator 400 substantially aligned with each other in the sub-scanning direction (Y-axis direction).

As illustrated in FIG. 7, most of the light travels straight. Thus, among the irradiation width Lh of the UV light in the sub-scanning direction, an illuminance of the UV light on a portion Lr/2 (Lr=Lh−L1) protruding from a normal irradiation width L1 is lower than an illuminance within the normal irradiation width L1. Thus, light quantity of the UV light is different according to the position to be irradiated.

Particularly, the illuminance of the UV light on the portion Lr/2 protruding from the normal irradiation width L1 decrease toward outside an illuminance area of the UV light. If the center C1 of the liquid surface 102 and the center C2 of the irradiator 400 are substantially aligned as described above, the irradiator 400 can irradiates the liquid surface 102 with the most uniform light quantity. Thus, a clean liquid surface 102 can be obtained and deterioration in quality of the liquid surface 102 (image) can be prevented.

Figure 9:
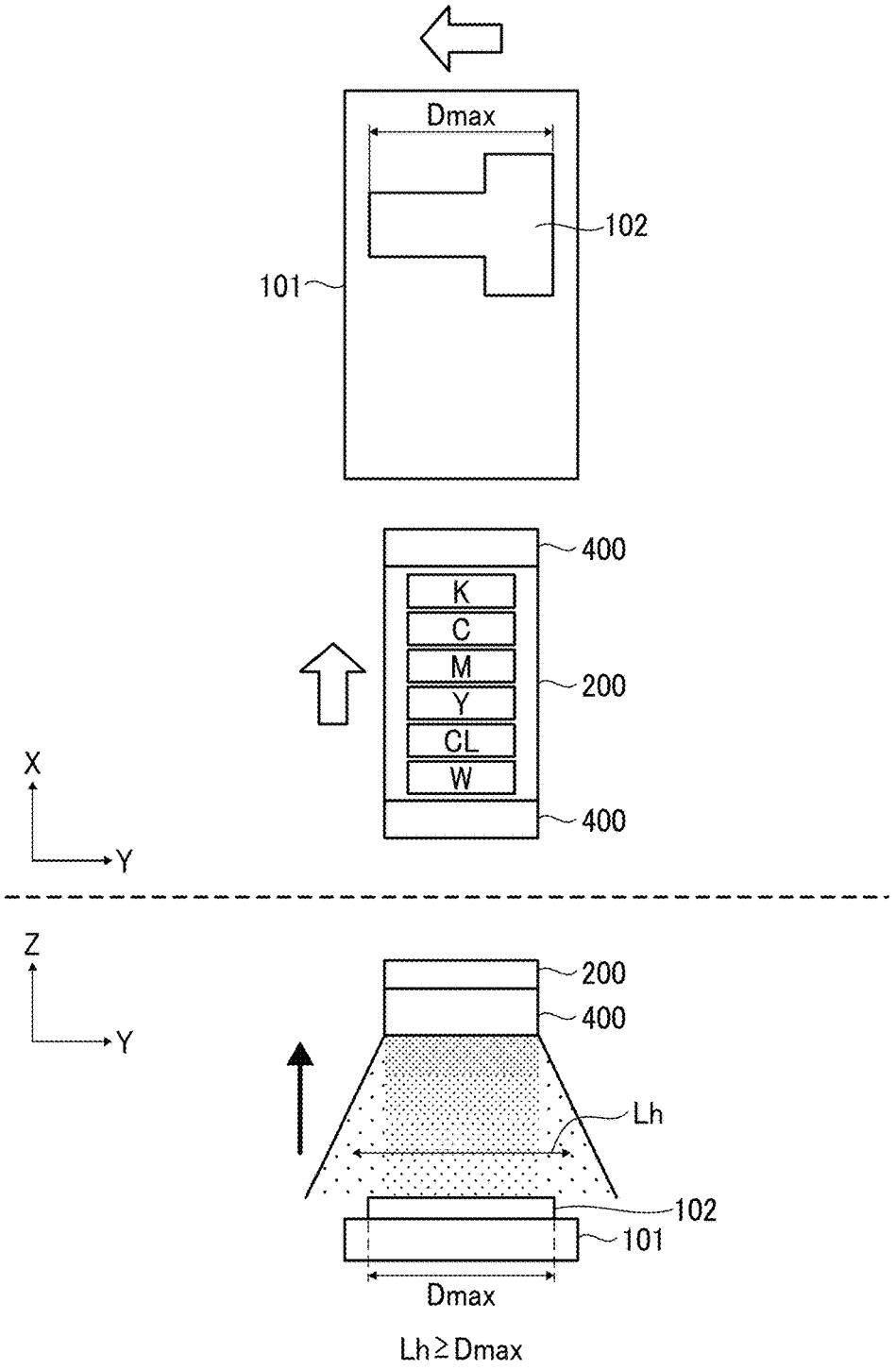
FIG. 9 is a schematic plan view and cross-sectional view of the liquid discharge apparatus illustrating another example of the irradiation operation in the present disclosure.

FIG. 9 illustrates an example of the irradiation operation in the present disclosure. FIG. 9 is different from the embodiment of FIG. 8 in that a shape of the liquid surface 102 formed on the substrate 101 is T-shaped.

As illustrated n FIG. 9, in case where the liquid surface 102 has a complex shape such as an ellipse and T-shaped other than a rectangle, for example, a maximum width Dmax in the sub-scanning direction of the liquid surface 102 is used as the width D in the sub-scanning direction of the liquid surface 102.

Therefore, as illustrated in FIG. 9, the movement controller 601 controls the height adjuster 207 to move the irradiator 400 (carriage 200) to the height corresponding to the irradiation distance h at which the irradiation width Lh of the UV light from the irradiator 400 in the sub-scanning direction is equal to or greater than the maximum width Dmax in the sub-scanning direction of the liquid surface 102 (Lh≥Dmax).

Then, the movement controller 601 controls the scanner 206 to reciprocally scans the irradiator 400 (carriage 200) in the main scanning direction (X-axis direction) of the liquid surface 102.

Figure 10:
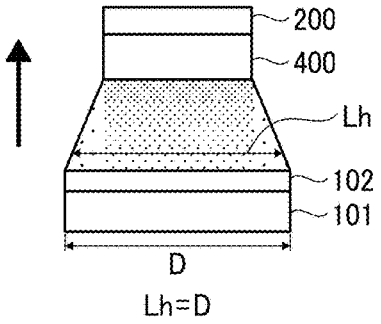
FIG. 10 is a schematic cross-sectional view of the liquid discharge apparatus illustrating an example of the irradiation operation in the present disclosure.

As the irradiation distance of the UV light becomes longer, the light diffuses, and the illuminance decreases. As illustrated in FIG. 10, the movement controller 601 preferably controls the height adjuster 207 to move the carriage 200 to the height corresponding to the irradiation distance h at which the irradiation width Lh of the UV light from the irradiator 400 in the sub-scanning direction is equal to the width D of the liquid surface 102 in the sub-scanning direction (Lh=D).

Thus, there is no need to increase the illuminance of UV light more than necessary, and scattering of light can be suppressed, so that a clean liquid surface 102 is obtained and the deterioration in quality of the image (liquid surface 102) can be prevented.

In addition, the irradiation controller 603 may control the irradiator 400 to irradiate the UV light at an output level corresponding to the irradiation distance h of the UV light. As described above, the longer the irradiation distance of the UV light is, the lower the illuminance becomes. Therefore, depending on the irradiation distance h of the UV light, the light quantity of UV light may be insufficient to cure the UV-curable ink.

Therefore, the irradiation controller 603 may increase the output level of the UV light with an increase in the irradiation distance h when irradiating the UV light.

Figure 11:
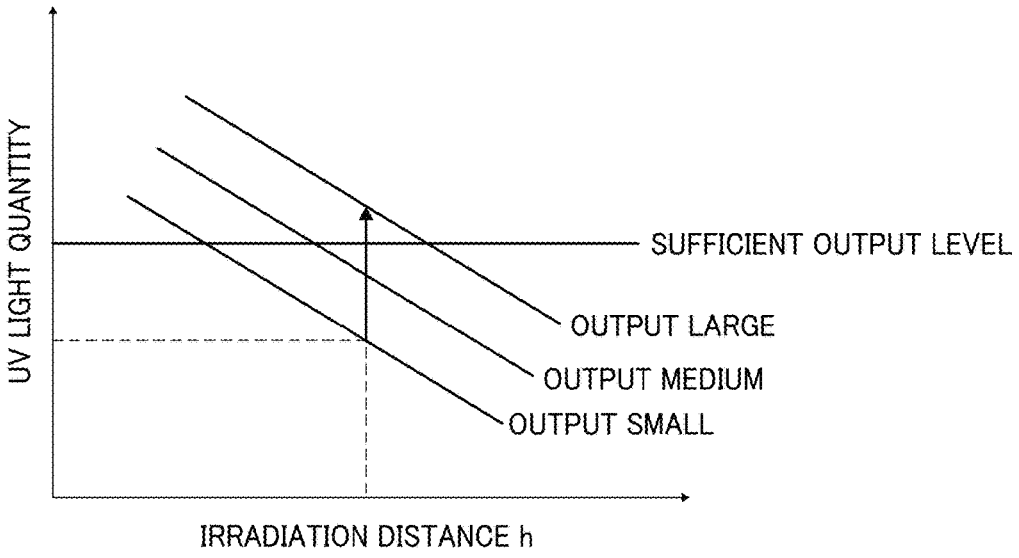
FIG. 11 is a graph illustrating an example of an output level of the UV light according to an embodiment of the present disclosure.

For example, as illustrated in FIG. 11, three stages of the output levels of the UV light are prepared, such as small, medium, and large.

The irradiation controller 603 controls the irradiator 400 to irradiate the liquid surface 102 with higher output level as the increase in the irradiation distance h between the irradiator 400 and the liquid surface 102.

Specifically, the above-described three levels of output levels are previously stored in the memory 32. The irradiation controller 603 adopts the output level among the three stages of the output levels that satisfies the condition of the lowest output level having a light quantity enough to cure the liquid surface 102 with the UV light at the height corresponding to the irradiation distance h between the irradiator 400 and the liquid surface 102.

The light quantity enough to cure the liquid surface 102 with the UV light is indicated in FIG. 11 as a "sufficient output level".

In this way, the irradiator 400 irradiates the UV light at a higher output level with the increase in the irradiation distance h of the UV light.

Thus, the irradiator 400 can irradiate the liquid surface 102 with the UV light having sufficient light quantity for curing the UV-curable ink even when the irradiation distance of the UV light is large.

Further, the movement controller 601 may move the irradiator 400 (carriage 200) in the main scanning direction (X-axis direction) perpendicular to the width D direction of the liquid surface 102 (Y-axis direction or sub-scanning direction) at a speed corresponding to the irradiation distance h of the UV light.

As described above, the illuminance of the UV light decreases with increase in the irradiation distance of the UV light. Therefore, the light quantity of UV light may be insufficient to cure the UV-curable ink depending on the irradiation distance h of the UV light.

Therefore, the movement controller 601 reduce a speed of scanning the irradiator 400 (carriage 200) in the main scanning direction (X-axis direction) with increase in the irradiation distance h of the UV light. The movement controller 601 then irradiates the liquid surface 102 while reciprocally moving (scanning) the irradiator 400 (carriage 200) with the reduced speed in the main scanning direction (X-axis direction).

Figure 12:
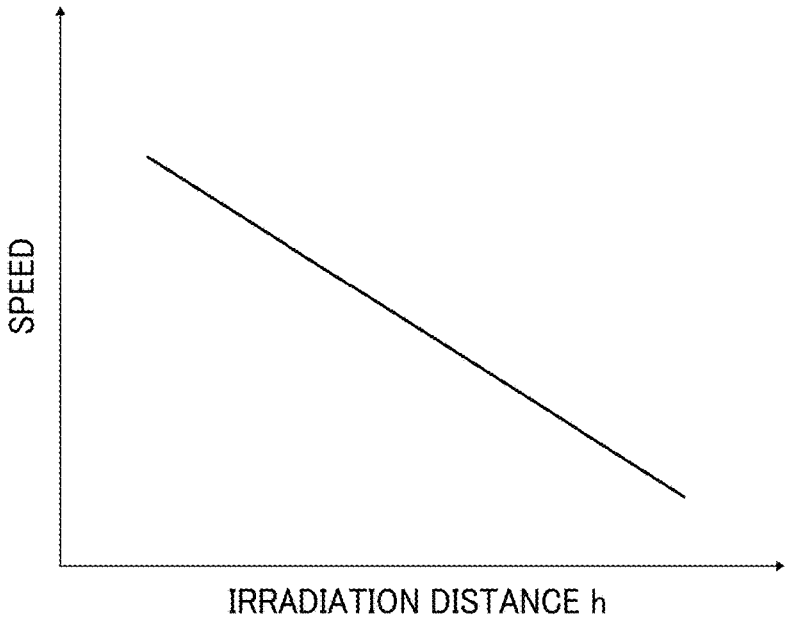
FIG. 12 is a graph illustrating an example of a relation between the irradiation distance of the UV light and a speed of moving the irradiator (carriage) according to the embodiment of the present disclosure.

For example, the memory 32 previously stores information regarding relation between the irradiation distance h of the UV light and the speed of scanning the irradiator 400 (carriage 200) as illustrated in FIG. 12.

The movement controller 601 may reciprocally move (scan) the irradiator 400 (carriage 200) in the main scanning direction (X-axis direction) of the liquid surface (image) 102 at the speed corresponding to the irradiation distance h of the UV light. Thus, the speed of scanning the irradiator 400 (the carriage 200) is reduced with increase in the irradiation distance h of the UV light.

Thus, the present embodiment can increase irradiation time for irradiating the liquid surface 102 with the UV light. Thus, the present embodiment can ensure the light quantity of the UV light sufficient for curing the UV-curable ink even when the irradiation distance of the UV light is large.

Especially, the present embodiment of adjusting the speed of scanning the irradiator 400 is useful when the light quantity of the UV light of maximum output level is insufficient to cure the UV-curable ink.

There may be a case in which the irradiator 400 cannot irradiate all the area of the liquid surface 102 in the sub-scanning direction (Y-axis direction) with the UV light at once when the irradiator 400 (carriage 200) is at the maximum height of the irradiator 400 (carriage 200) that corresponds to the maximum irradiation distance of the irradiator 400.

Thus, the movement controller 601 preferably scans the irradiator 400 (carriage 200) in the main scanning direction (X-axis direction) of the liquid surface 102 to irradiate an end of the liquid surface 102 in the sub-scanning direction (Y-axis direction) with the UV light having large light quantity. The sub-scanning direction (Y-axis direction) is direction along the width D of the liquid surface 102.

Figure 13:
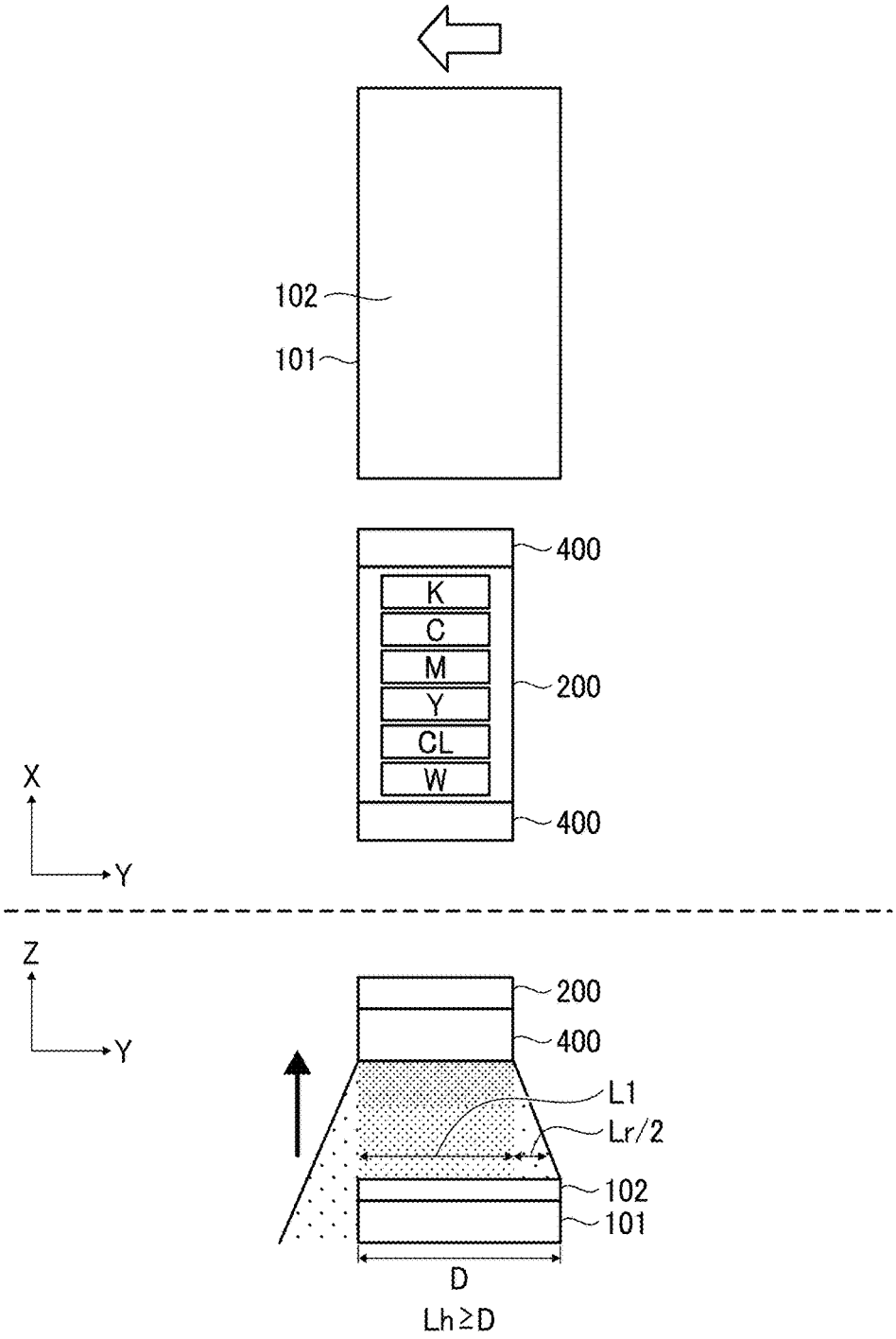
FIG. 13 is a schematic plan view and cross-sectional view of the liquid discharge, apparatus illustrating still another example of the irradiation operation in the present disclosure.

For example, as illustrated in FIG. 13, the conveyor 100 previously moves the substrate 101 in the sub-scanning direction (Y-axis direction) so that one end (left end in FIG. 13) of the normal irradiation width L1 of the UV light of the irradiator 400 in the sub-scanning direction is substantially aligned with one end (left end in FIG. 13) of the width D of the liquid surface 102 in the sub-scanning direction (The left end in FIG. 13).

Further, as illustrated in FIG. 13, the movement controller 601 moves the irradiator 400 (carriage 200) to the height where the light quantity of the UV light in the portion of Lr/2 protruding from the normal irradiation width L1 in the irradiation width Lh in the sub-scanning direction (Y-axis direction) is below the sufficient output level for sufficiently curing the liquid surface 102.

In this way, the present embodiment can prevent an occurrence of uncured portion or insufficiently cured portion in the liquid surface 102 on both ends of the liquid surface 102 in the sub-scanning direction by irradiating the UV light to the liquid surface 102 with the irradiator 400 while scanning the irradiator 400 (carriage 200) in the main scanning direction (X-axis direction). That is, it is possible to reduce the number of times of additional irradiation for completely curing an insufficiently cured portion from twice to once.

Further, the portion Lr/2 protruding from the normal irradiation width L1 is irradiated with UV light having a light quantity below the sufficient output level to cure the liquid surface 102. Thus, a degree of curing shrinkage created in this portion is small, and the degree of wrinkles 103 created at a boundary between the cured portion and the uncured portion is also small.

Figure 14:
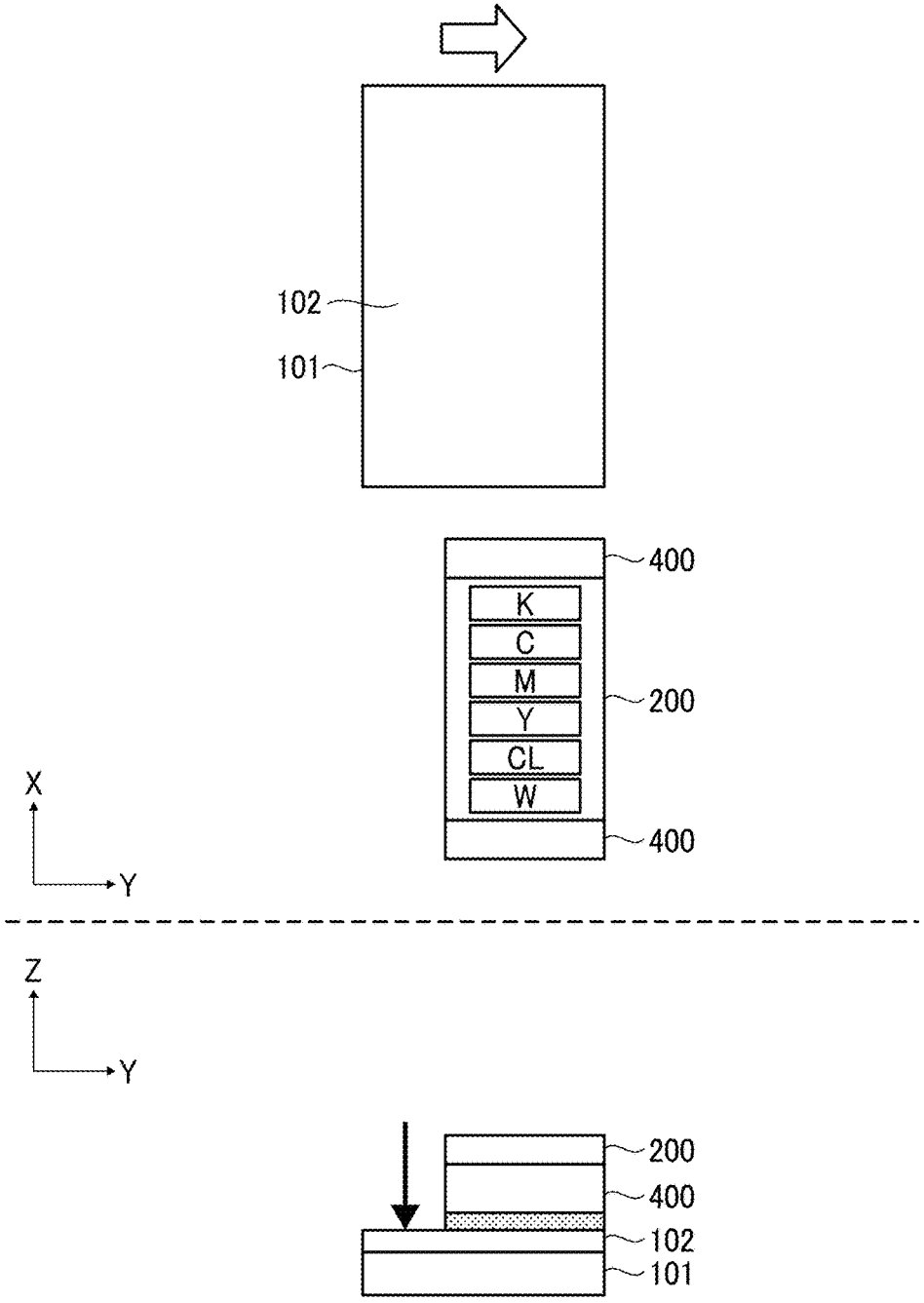
FIG. 14 is a schematic plan view and cross-sectional view of the liquid discharge, apparatus illustrating still another example of the irradiation operation in the present disclosure.

As illustrated in FIG. 14, the conveyor 100 previously moves the substrate 101 in the sub-scanning direction (Y-axis direction) so that the irradiator 400 can irradiates a portion of the liquid surface 102 (right end portion of the liquid surface 102 in FIGS. 13 and 14) to which the UV light of the portion Lr/2 protruding from the normal irradiation width L1 is irradiated in FIG. 13.

At this time, the irradiator 400 irradiates the right end portion of the liquid surface 102 with the UV light within the normal irradiation width L1 as illustrated in FIG. 14.

The height adjuster 207 moves the irradiator 400 (carriage 200) at the height corresponding to the irradiation distance suitable for discharging the UV-curable ink by the heads 300 such as 1 mm.

The scanner 206 reciprocally moves (scans) the irradiator 400 (the carriage 200) in the main scanning direction (X-axis direction) and irradiates the liquid surface 102 with the UV light by the irradiator 400.

In this way, the present embodiment can cure and hardens all the surface of the liquid surface 102 while preventing deterioration of the quality of the liquid surface 102 (image) even when the irradiator 400 cannot irradiate the liquid surface 102 at once with the UV light.

Figure 15:
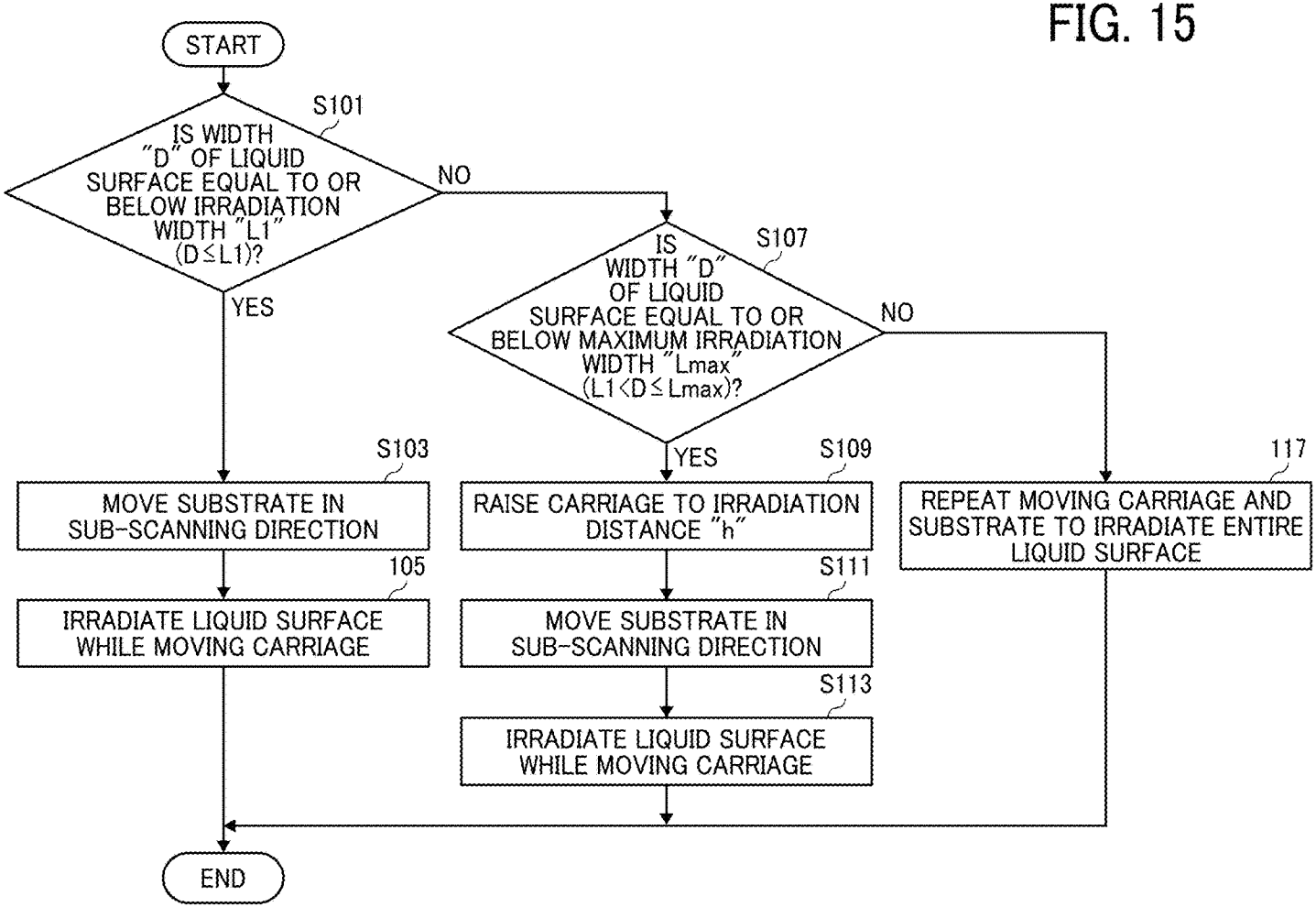
FIG. 15 is a flowchart that illustrates an example of a curing process according to the present disclosure.

FIG. 15 is a flowchart that illustrates an example of a curing process according to the present disclosure.

In FIG. 15, an example is described in which a height of the irradiator 400 (carriage 200) at a time of starting the curing process is at a height (1 mm, for example) suitable for discharge the UV-curable ink by the heads 300 as described above. However, a height of the irradiator 400 (carriage 200) is not limited to this example.

First, the movement controller 601 checks whether the width D of the liquid surface 102 in the sub-scanning direction is equal to or smaller than the normal irradiation width L1 of the UV light in the sub-scanning direction (D≤L1) (S101).

If D≤L1 (Yes in step S101), the movement controller 601 controls the conveyor 100 to move the substrate 101 in the sub-scanning direction so that a center C1 of the liquid surface 102 in the direction of width D of the liquid surface 102 in the sub-scanning direction is substantially aligned with a center C2 of the irradiator 400 (irradiation width L1) in the sub-scanning direction (step S103).

While the scanner 206 of the movement controller 601 scans (reciprocally moves) the irradiator 400 (carriage 200)

in the main scanning direction (X-axis direction), the irradiation controller 603 controls the irradiator 400 to irradiate the liquid surface 102 with the UV light to cure and harden the liquid surface 102 (step S105).

On the other hand, when a condition of D≤L1 is not satisfied (No in step S101), the movement controller 601 determines whether the width D of the liquid surface 102 in the sub-scanning direction is equal to or less than the maximum irradiation width Lmax of the UV light in the sub-scanning direction (L1<D≤Lmax) (step S107).

If the condition of L1<D≤Lmax (Yes in step S107) is satisfied, the movement controller 601 moves the irradiator 400 (carriage 200) to the height corresponding to the irradiation distance h at which the irradiation width Lh of the UV light in the sub-scanning direction is equal to or larger than the width D of the liquid surface 102 in the sub-scanning direction (Lh≥D) (step S109).

Next, the movement controller 601 controls the conveyor 100 to move the substrate 101 in the sub-scanning direction so that a center C1 of the liquid surface 102 (center of width D) in the sub-scanning direction is substantially aligned with a center C2 of the irradiator 400 (center of irradiation width L1) in the sub-scanning direction (step S111).

While the scanner 206 of the movement controller 601 scans (reciprocally moves) the irradiator 400 (carriage 200) in the main scanning direction (X-axis direction), the irradiation controller 603 controls the irradiator 400 to irradiate the liquid surface 102 with the UV light to cure and harden the liquid surface 102 (step S113).

On the other hand, if the condition of L1<D≤Lmax is not satisfied (No in step S107), the movement controller 601 controls the conveyor 100 to move the substrate 101 in the sub-scanning direction so that one end of the normal irradiation width L1 of the UV light of the irradiator 400 in the sub-scanning direction is substantially aligned with one end of the width D of the liquid surface 102 in the sub-scanning direction (See FIG. 13).

The movement controller 601 further raise the irradiator 400 (carriage 200) to the height corresponding to the irradiation distance h at which the light quantity of the portion Lr/2 protruding from the normal irradiation width L1 in the irradiation width Lh in the sub-scanning direction is less than the sufficient output level for curing the liquid surface 102.

While the scanner 206 of the movement controller 601 scans (reciprocally moves) the irradiator 400 (carriage 200) in the main scanning direction (X-axis direction), the irradiation controller 603 controls the irradiator 400 to irradiate the liquid surface 102 with the UV light to cure and harden the liquid surface 102. The movement controller controls the conveyor 100 to move the substrate 101 for the normal irradiation width L1 in the sub-scanning direction.

Then, while the scanner 206 of the movement controller 601 scans (reciprocally moves) the irradiator 400 (carriage 200) in the main scanning direction (X-axis direction), the irradiation controller 603 controls the irradiator 400 to irradiate the liquid surface 102 with the UV light to cure and harden the liquid surface 102.

The controller 3 repeats the above described process of moving the substrate 101 and the irradiator 400 to irradiate and cure all of the liquid surface 102 (step S117).

As described above, according to the present embodiment, quality deterioration of a liquid surface (image) 102 can be suppressed irrespective of the degree of curing shrinkage. Specifically, the present embodiment can prevent forming of coating film having appearance defects on the liquid surface (image) 102.

Thus, the present embodiment can prevent degradation of the quality of the liquid surface (image) 102.

Figure 16:
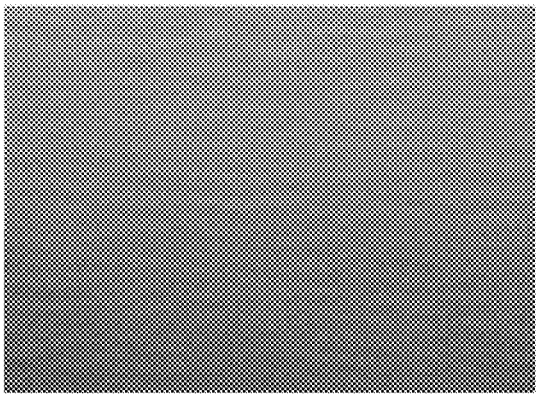
FIG. 16 illustrates an example of a result of a curing process according to the present disclosure.

FIG. 16 illustrates the case in which the method according to the present disclosure is adopted. As can be seen from FIG. 16, no wrinkles 103 are observed in the coating film and degradation of the quality of the liquid surface 102 is prevented.

Figure 17:
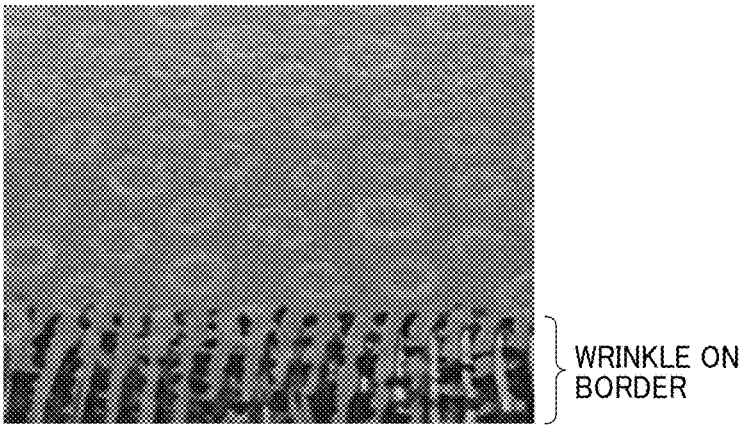
FIG. 17 illustrates an example of a result of a conventional curing process.

On the other hand, FIG. 17 illustrates the case in which the ordinal method is adopted. As can be seen from FIG. 17, wrinkles 103 on the border are observed in the coating film, and the degradation of the quality of the liquid surface 102 is created.

Further, according to the present embodiment, the illuminance of the UV light is adjusted according to the irradiation distance h of the UV light. Thus, any type of the UV irradiation lamp may be used for constituting the irradiator 400 in the present embodiment.

That is, not only the UV irradiation lamp of a Light Emitting Diode (LED) type capable of adjusting the output level of the UV irradiation lamp (irradiator 400), the present embodiment can also adopt a high output lamp such as a metal halide that is difficult to adjust the output level of the UV irradiation lamp (irradiator 400).

In the above described embodiments, an example of changing the irradiation distance of the UV light of the irradiator 400 by moving the irradiator 400 (carriage 200) in the Z-axis direction (height direction) has been described.

However, the method of changing the irradiation distance of the UV light of the irradiator 400 is not limited to the method described above.

For example, the irradiation distance of the UV light of the irradiator 400 may be changed by fixing the height of the irradiator 400 (carriage 200) and moving the substrate 101 in the Z-axis direction (height direction).

Further, the irradiation distance of the UV light of the irradiator 400 may be changed by moving both the carriage 200 and the substrate 101 in the Z-axis direction (height direction).

Computer Program Product

A computer program product including a program executed by the liquid discharge apparatus 1 according to the above described embodiments and variations is provided to the user by being recorded on computer-readable recording media (non-transitory computer-readable medium) such as a compact disc read-only memory (CD-ROM), a compact disc-recordable (CD-R), a memory card, a digital versatile disc (DVD), a flexible disk (FD), in the file form installable into or executable by the PC 2 or by the controller 3 of the liquid discharge apparatus 1.

Further, the program executed by the liquid discharge apparatus 1 in the above described embodiments and variations may be provided by being stored on a computer connected to a network such as an internet, and the program may be provided to the user via the network so that the user may download the program via the network.

The program executed by the liquid discharge apparatus 1 according to the above described embodiments and variations or by the PC 2 may be provided or distributed via a network such as the Internet. Further, a program executed by the liquid discharge apparatus 1 according to the above described embodiments and variations or by the PC 2 may be a built-in read-only memory (ROM), etc.

Further, a program executed by the liquid discharge apparatus 1 according to the above described embodiments and variations or by the PC 2 has a modular architecture to realize each of the above described parts on the PC 2 or the controller 3. As the hardware to execute the program, the CPU 33 reads out the program from the read-only memory (ROM) onto the random access memory (RAM) in the memory 32 and executes to realize each of the above described functional parts on the PC 2 or the controller 3.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

"A liquid discharge device" is an integrated unit including the head and a functional part(s) or unit(s), and is an assembly of parts relating to liquid discharge. For example, "the liquid discharge device" may be a combination of the head with at least one of a head tank, a carriage, a supply unit, a maintenance unit, and a drive unit.

Herein, the terms "integrated" or "united" mean fixing the head and the functional parts (or mechanism) to each other by fastening, screwing, binding, or engaging and holding one of the head and the functional parts movably relative to the other. The head may be detachably attached to the functional part(s) or unit(s) each other.

For example, the head and a head tank may be integrated into a single unit as the liquid discharge device. The head and the head tank may be connected each other via, e.g., a tube to integrally form the liquid discharge device. Here, a unit including a filter may further be added to a portion between the head tank and the head of the liquid discharge device.

The liquid discharge device may be an integrated unit in which a head is integrated with a carriage.

The liquid discharge device may be the head movably held by a guide that forms part of a drive unit, so that the head and the drive unit are integrated as a single unit. The liquid discharge device may include the head, the carriage, and the drive unit that are integrated as a single unit.

In another example, a cap that forms part of a maintenance unit is secured to the carriage mounting the head so that the head, the carriage, and the maintenance unit are integrated as a single unit to form the liquid discharge device.

Further, the liquid discharge device may include tubes connected to the head mounted on the head tank or the channel member so that the head and the supply unit are integrated as a single unit. Liquid is supplied from a liquid reservoir source such as liquid cartridge to the head through the tube.

The drive unit may be a guide only. The supply unit may be a tube(s) only or a mount part (loading unit) only.

The term "liquid discharge apparatus" used herein also represents an apparatus including the head or the liquid discharge device to discharge liquid by driving the head. The liquid discharge apparatus may be, for example, an apparatus capable of discharging liquid onto a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid onto a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of "the liquid discharge apparatus" further include a treatment liquid coating apparatus to discharge a treatment liquid onto a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above. The methods described above can be provided as program codes stored in a recording medium, to cause a processor to execute the method when executed by at least one processor.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A liquid discharge apparatus comprising:

a liquid discharge head to discharge liquid to a medium to form liquid surface on the medium;

an irradiator to irradiate the liquid surface with active energy rays;

a carriage mounting the liquid discharge head and the irradiator;

a scanner to scan the carriage in a main scanning direction;

a height adjuster to adjust an irradiation distance between the irradiator and the liquid surface by relatively moving the carriage and the medium;

a conveyor to move the medium and the carriage relatively in a sub-scanning direction perpendicular to the main scanning direction; and control circuitry to control the irradiator to irradiate the liquid surface with the active energy rays while scanning the carriage in the main scanning direction, the height adjuster adjusting the irradiation distance at a first distance in response to a maximum width of the liquid surface in the sub-scanning direction being a first width and adjusting the irradiation distance at a second distance larger than the first distance in response to the maximum width of the liquid surface in the sub-scanning direction being a second width larger than the first width, and the control circuitry irradiating the liquid surface with the active energy rays by the irradiator while maintaining the irradiation distance at the first distance or the second distance as determined by the maximum width using the height adjuster.

2. The liquid discharge apparatus according to claim 1, wherein the height adjuster moves the irradiator to a height determined by the maximum width of the liquid surface in the sub-scanning direction.

3. The liquid discharge apparatus according to claim 1, wherein the control circuitry controls the irradiator to irradiate the active energy rays to the liquid surface at an output level determined by the irradiation distance.

4. The liquid discharge apparatus according to claim 1, wherein the scanner scans the carriage in the main scanning direction at a speed determined by the irradiation distance.

5. The liquid discharge apparatus according to claim 1, wherein the conveyor conveys the medium to a position where a center of the liquid surface is aligned with a center of the irradiator in the sub-scanning direction, and the control circuitry drives the scanner to scan the irradiator in the main scanning direction.

6. The liquid discharge apparatus according to claim 1, wherein the irradiation distance is a distance in which an irradiation width of the active energy rays irradiated from the irradiator covers the maximum width of the liquid surface in the sub-scanning direction.

7. The liquid discharge apparatus according to claim 1, wherein the control circuitry controls the irradiator to change a light quantity of the active energy rays according to the irradiation distance, and the control circuitry controls the scanner to scan the irradiator in the main scanning direction to irradiate an end of the liquid surface in the sub-scanning direction with the active energy rays.

8. A liquid curing method comprising:

discharging liquid to a medium to form liquid surface on the medium;

irradiating the liquid surface with active energy rays using an irradiator;

adjusting an irradiation distance between the irradiator and the liquid surface by relatively moving the irradiator with the medium;

scanning the irradiator in a main scanning direction;

moving the medium and the irradiator relatively in a sub-scanning direction perpendicular to the main scanning direction; and controlling irradiation of the liquid surface with the active energy rays while scanning the irradiator in the main scanning direction, wherein the adjusting adjusts the irradiation distance at a first distance in response to a maximum width of the liquid surface in the sub-scanning direction being a first width and adjusts the irradiation distance at a second distance larger than the first distance in response to the maximum width of the liquid surface in the sub-scanning direction being a second width larger than the first width, and the controlling irradiates the liquid surface with the active energy rays while maintaining the irradiation distance at the first distance or the second distance as determined by the maximum width.

9. A computer program product comprising a non-transitory computer-readable medium containing an information processing program, the program causing a computer in a device to perform:

discharging liquid to a medium to form liquid surface on the medium with a liquid discharge head;

irradiating the liquid surface with active energy rays using an irradiator;

adjusting an irradiation distance between the irradiator and the liquid surface by relatively moving the irradiator with the medium;

scanning the irradiator in a main scanning direction;

moving the medium and the irradiator relatively in a sub-scanning direction perpendicular to the main scanning direction; and controlling irradiation of the liquid surface with the active energy rays while scanning the irradiator in the main scanning direction, wherein the adjusting adjusts the irradiation distance at a first distance in response to a maximum width of the liquid surface in the sub-scanning direction being a first width and adjusts the irradiation distance at a second distance larger than the first distance in response to the maximum width of the liquid surface in the sub-scanning direction being a second width larger than the first width, and the controlling irradiates the liquid surface with the active energy rays while maintaining the irradiation distance at the first distance or the second distance as determined by the maximum width.

* * * * *